US011725660B2

(12) United States Patent
Morishima et al.

(10) Patent No.: US 11,725,660 B2
(45) Date of Patent: Aug. 15, 2023

(54) HORIZONTAL COMPRESSOR AND REFRIGERATION CYCLE SYSTEM

(71) Applicant: Toshiba Carrier Corporation, Kawasaki (JP)

(72) Inventors: Akira Morishima, Fuji (JP); Keiichi Hasegawa, Fuji (JP); Shinya Goto, Fuji (JP); Jafet Ferdhy Monasry, Fuji (JP); Masaya Ichihara, Fuji (JP)

(73) Assignee: TOSHIBA CARRIER CORPORATION, Kawasaki (JP)

( * ) Notice: Subject to any disclaimer, the term of this patent is extended or adjusted under 35 U.S.C. 154(b) by 509 days.

(21) Appl. No.: 16/904,372

(22) Filed: Jun. 17, 2020

(65) Prior Publication Data

US 2020/0318639 A1 Oct. 8, 2020

Related U.S. Application Data

(63) Continuation of application No. PCT/JP2017/046463, filed on Dec. 25, 2017.

(51) Int. Cl.
*F04C 23/00* (2006.01)
*F04C 29/00* (2006.01)
(Continued)

(52) U.S. Cl.
CPC ..... *F04C 23/008* (2013.01); *F04C 29/0021* (2013.01); *F04C 29/12* (2013.01);
(Continued)

(58) Field of Classification Search
CPC .. F01C 21/007; F04C 2240/30; F04C 23/008; F04C 29/12; F04C 29/0021; F25B 2500/13
See application file for complete search history.

(56) References Cited

U.S. PATENT DOCUMENTS

2004/0057849 A1* 3/2004 Skinner ..... F04C 29/026 417/410.5
2005/0129559 A1* 6/2005 Hasegawa ..... F01C 21/108 418/88
(Continued)

FOREIGN PATENT DOCUMENTS

EP 1 770 281 A2 4/2007
JP 2004026985 A * 1/2004 ..... F25B 9/006
(Continued)

OTHER PUBLICATIONS

English Machine Translation of JP 2004-26985 (Year: 2004).*
Microfilm of the specification and drawings annexed to the request of Japanese Utility Model Application No. 126503/1983 (Laid-open No. 34194/1985), issued Mar. 8, 1985 to Mitsubishi Electronics Corp.
(Continued)

*Primary Examiner* — Anthony Ayala Delgado
(74) *Attorney, Agent, or Firm* — John P. White

(57) ABSTRACT

According to one embodiment, a horizontal compressor comprises a container accommodating a compression mechanism unit and an electric motor unit, a first leg fixed to the container near the motor unit, a second leg fixed to an end of the container on the compression mechanism unit side, an accumulator between the legs, and a joint port in the container. The second leg includes a first support portion supporting the container in a horizontal attitude, and a second support portion supporting the container standing in a vertical attitude. The first support portion extends in a direction away from the joint port relative to the second support portion.

13 Claims, 9 Drawing Sheets

(51) Int. Cl.

| | |
|---|---|
| ***F04C 29/12*** | (2006.01) |
| ***F25B 1/00*** | (2006.01) |
| ***F25B 1/04*** | (2006.01) |
| ***F25B 31/02*** | (2006.01) |

(52) U.S. Cl.
CPC ..... *F25B 1/005* (2013.01); *F25B 1/04* (2013.01); *F25B 31/026* (2013.01); *F04C 2240/30* (2013.01); *F04C 2240/40* (2013.01)

(56) References Cited

U.S. PATENT DOCUMENTS

2007/0077161 A1* 4/2007 Roller ..... F04C 23/008 418/55.6
2007/0116582 A1* 5/2007 Skinner ..... F04C 18/0215 417/360

FOREIGN PATENT DOCUMENTS

JP 2005-83269 A 3/2005
WO WO 2004-011809 A1 2/2004

OTHER PUBLICATIONS

Microfilm of the specification and drawings annexed to the request of Japanese Utility Model Application No. 11959/1979 (Laid-open No. 112191/1980), issued Aug. 7, 1980 to Mitsubishi Electronics Corp.
International Search Report dated Mar. 13, 2018 in connection with PCT International Application No. PCT/JP2017/046463.
Written Opinion (form PCT/ISA/237) dated Mar. 13, 2018 in connection with PCT International Application No. PCT/JP2017/046463.
European search report dated Jun. 16, 2021 in corresponding European Patent Application No. 17 93 6810.5.

* cited by examiner

HORIZONTAL COMPRESSOR AND REFRIGERATION CYCLE SYSTEM

CROSS-REFERENCE TO RELATED APPLICATIONS

This application is a Continuation Application of PCT Application No. PCT/JP2017/046463, filed Dec. 25, 2017, the entire contents of which are incorporated herein by reference.

FIELD

Embodiments described herein relate generally to a horizontal compressor and a refrigeration cycle system including the compressor.

BACKGROUND

Horizontal compressors each include a pair of first legs and a second leg, in which the pair of first legs support a hermetic container in a horizontal attitude on an installation surface, the container storing a compression mechanism unit and an electric motor unit, and the second leg is used to stand the hermetic container in a manufacturing process of the horizontal compressor. The first legs are spatially arranged in the axial direction of the hermetic container. The second leg is arranged at one end of the hermetic container located on the side of the compression mechanism unit and is adjacent to one of the first legs near the compression mechanism unit.

Such a configuration inevitably increases the number of components of the horizontal compressor due to the first legs and second leg near the compression mechanism unit that have different and independent components and further increases labor-hours required for mounting the legs to the hermetic container.

As a measure against this, horizontal compressors are conventionally known, each of which includes a second leg located at one end of a hermetic container, the second leg being integrally provided with a support piece bent to face an installation surface when supporting the hermetic container in a horizontal attitude.

This type of horizontal compressor has an integrated structure in which the second leg has both of a function of supporting the hermetic container in a horizontal attitude and a function of standing the hermetic container. Thus, it becomes possible to omit a first leg adjacent to the second leg, and it becomes possible to reduce the number of components of the horizontal compressor and reduce the labor-hours required for assembling the horizontal compressor.

Incidentally, in the horizontal compressor, a joint port that communicates with a cylinder chamber of the compression mechanism unit is arranged in an outer peripheral surface of the hermetic container. The joint port protrudes outward from the hermetic container, at a position corresponding to the compression mechanism unit, and the joint port is connected to an accumulator attached to the hermetic container via a refrigerant return pipe. The refrigerant return pipe is fixed to an opening end of the joint port by means such as brazing.

However, in the conventional horizontal compressor in which the second leg has both of the function of supporting the hermetic container in a horizontal attitude and the function of standing the hermetic container, the support piece expands from the second leg to the joint port. Accordingly, an end of the support piece is located immediately in front of the joint port, and the interval between the end of the support piece and the joint port is very small.

Therefore, for brazing the refrigerant return pipe to the joint port, the support piece may hinder the brazing, and it is undeniable that the productivity of the horizontal compressor is diminished.

DETAILED DESCRIPTION

In general, according to one embodiment, a horizontal compressor comprises a cylindrical hermetic container, a compression mechanism unit, an electric motor unit, a first leg, a second leg, an accumulator, and a joint port. The compression mechanism unit is housed in the hermetic container to compress a refrigerant. The electric motor unit is housed in the hermetic container so as to be aligned with the compression mechanism unit in an axial direction of the hermetic container, and drives the compression mechanism unit. The first leg is fixed to the hermetic container at a position near the electric motor unit to support the hermetic container in a horizontal attitude on an installation surface. The second leg is fixed to an end of the hermetic container located on the side of the compression mechanism unit to support the hermetic container in a horizontal attitude on the installation surface. The accumulator is attached to the hermetic container, between the first leg and the second leg. The joint port is provided in the hermetic container to join a refrigerant return pipe. The refrigerant return pipe guides a refrigerant in the accumulator to the compression mechanism unit. The second leg includes a first support portion of plate shape that faces the installation surface to support the hermetic container in a horizontal attitude, and a second support portion of plate shape that supports the hermetic container standing in a vertical attitude. The first support portion extends in a direction away from the joint port relative to the second support portion.

First Embodiment

The first embodiment will be described below with reference to FIGS. 1 to 8.

Figure 1:
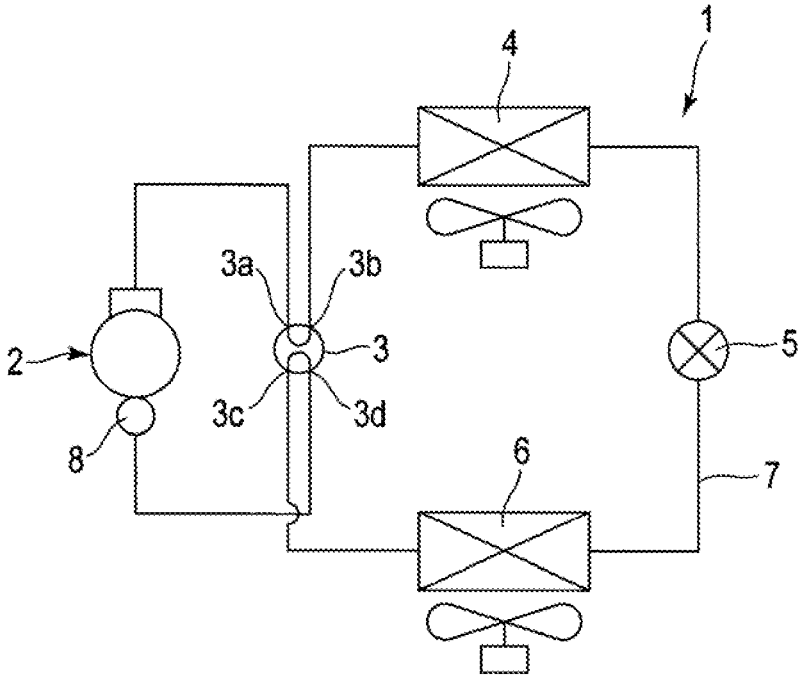
FIG. 1 is a schematic circuit diagram illustrating a configuration of a refrigeration cycle system according to an embodiment.

FIG. 1 is a diagram of a refrigeration cycle circuit of an air conditioner 1 that is an example of a refrigeration cycle system. The air conditioner 1 includes, as main elements, a horizontal compressor 2, a four-way valve 3, an outdoor heat exchanger 4, an expansion device 5, and an indoor heat exchanger 6. A plurality of the elements constituting the air conditioner 1 is connected via a circulation circuit 7 in which a refrigerant circulates.

Specifically, as illustrated in FIG. 1, a discharge side of the horizontal compressor 2 is connected to a first port 3*a* of the four-way valve 3. A second port 3*b* of the four-way valve 3 is connected to the outdoor heat exchanger 4. The outdoor heat exchanger 4 is connected to the indoor heat exchanger 6 via the expansion device 5. The indoor heat exchanger 6 is connected to a third port 3*c* of the four-way valve 3. A fourth port 3*d* of the four-way valve 3 is connected to a suction side of the horizontal compressor 2 via an accumulator 8.

When the air conditioner 1 operates in a cooling mode, the four-way valve 3 is switched so that the first port 3*a* communicates with the second port 3*b* and the third port 3*c* communicates with the fourth port 3*d*. When the operation of the air conditioner 1 is started in the cooling mode, a high-temperature and high-pressure gas-phase refrigerant obtained by compression by the horizontal compressor 2 is discharged to the circulation circuit 7. The discharged gas-phase refrigerant is guided to the outdoor heat exchanger 4 that functions as a radiator (condenser), via the four-way valve 3.

The gas-phase refrigerant guided to the outdoor heat exchanger 4 is condensed by heat exchange with air and changes into a high-pressure liquid-phase refrigerant. The high-pressure liquid-phase refrigerant is decompressed in the process of passing through the expansion device 5 and changes to a low-pressure gas-liquid refrigerant. The gas-liquid refrigerant is guided to the indoor heat exchanger 6 that functions as a heat absorber (evaporator) and is heat-exchanged with air in the process of passing through the indoor heat exchanger 6.

Therefore, the gas-liquid refrigerant is vaporized by absorbing heat from air and changes into a low-temperature and low-pressure gas-phase refrigerant. The air passing through the indoor heat exchanger 6 is cooled by latent heat of vaporization of the liquid-phase refrigerant, becomes cool air, and the cool air is sent to a place to be air-conditioned (cooled).

The low-temperature and low-pressure gas-phase refrigerant that has passed through the indoor heat exchanger 6 is guided to the accumulator 8 via the four-way valve 3. When the refrigerant contains the liquid-phase refrigerant that has not vaporized, the refrigerant is separated into a liquid-phase refrigerant and a gas-phase refrigerant in the accumulator 8. The low-temperature and low-pressure gas-phase refrigerant separated from the liquid-phase refrigerant is sucked from the accumulator 8 into the horizontal compressor 2 and compressed again into a high-temperature and high-pressure gas-phase refrigerant by the horizontal compressor 2, and the high-temperature and high-pressure gas-phase refrigerant is discharged to the circulation circuit 7.

On the other hand, when the air conditioner 1 operates in a heating mode, the four-way valve 3 is switched so that the first port 3*a* communicates with the third port 3*c* and the second port 3*b* communicates with the fourth port 3*d*. When the operation of the air conditioner 1 is started in the heating mode, a high-temperature and high-pressure gas-phase refrigerant discharged from the horizontal compressor 2 is guided to the indoor heat exchanger 6 via the four-way valve 3 and is heat-exchanged with air passing through the indoor heat exchanger 6. In other words, the indoor heat exchanger 6 functions as a condenser.

Therefore, the gas-phase refrigerant passing through the indoor heat exchanger 6 is condensed by heat exchange with air and changes into a high-pressure liquid-phase refrigerant. The air passing through the indoor heat exchanger 6 is heated by heat exchange with the gas-phase refrigerant, becomes hot air, and the hot air is sent to a place to be air-conditioned (heated).

The high-temperature liquid-phase refrigerant that has passed through the indoor heat exchanger 6 is guided to the expansion device 5, decompressed in the process of passing through the expansion device 5, and changes into a low-pressure gas-liquid refrigerant. The gas-liquid refrigerant is guided to the outdoor heat exchanger 4 that functions as an evaporator, vaporized by heat exchange with air herein, and changes into a low-temperature and low-pressure gas-phase refrigerant. The low-temperature and low-pressure gas-phase refrigerant that has passed through the outdoor heat exchanger 4 is sucked into the horizontal compressor 2 via the four-way valve 3 and accumulator 8.

Next, a specific configuration of the horizontal compressor 2 used for the air conditioner 1 will be described with reference to FIGS. 2 to 8. The horizontal compressor 2 is a rotary compressor that is installed in a horizontal attitude on a horizontal or nearly horizontal installation surface G, and the horizontal compressor 2 includes, as main elements, a hermetic container 10, a compression mechanism unit 11, and an electric motor unit 12.

The hermetic container 10 according to the present embodiment is divided into two elements of a container body 10*a* and a lid member 10*b*. The container body 10*a* includes a cylindrical outer peripheral wall 10*c*, and one axial end of the container body 10*a* is integrally closed by a bottom plate portion 10*d*. The bottom plate portion 10*d* is continuous with the outer peripheral wall 10*c* and is curved in a spherical shape so as to protrude axially from the container body 10*a*. Furthermore, the container body 10*a* includes a circular opening end 10*e* at the other end opposite to the bottom plate portion 10*d*.

The lid member 10*b* is fitted to the opening end 10*e* of the container body 10*a*, shield-welding is carried out on the entire circumference of the opening end 10*e*, and the lid member 10*b* is fixed to the container body 10*a*. Therefore, the opening end 10*e* of the container body 10*a* is airtightly closed by the lid member 10*b*.

Figure 2:
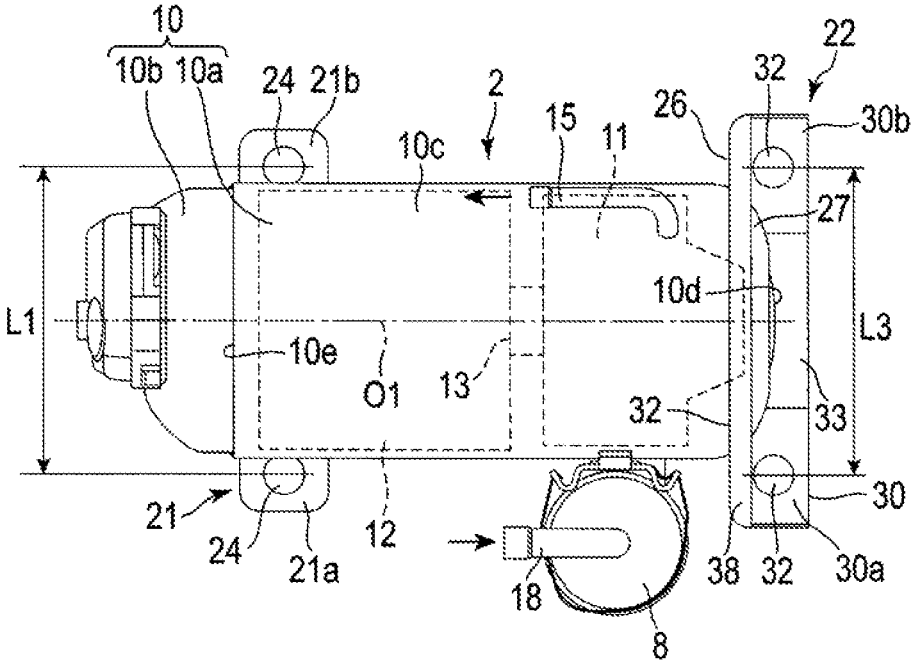
FIG. 2 is a plan view of a horizontal compressor according to a first embodiment.
Figure 3:
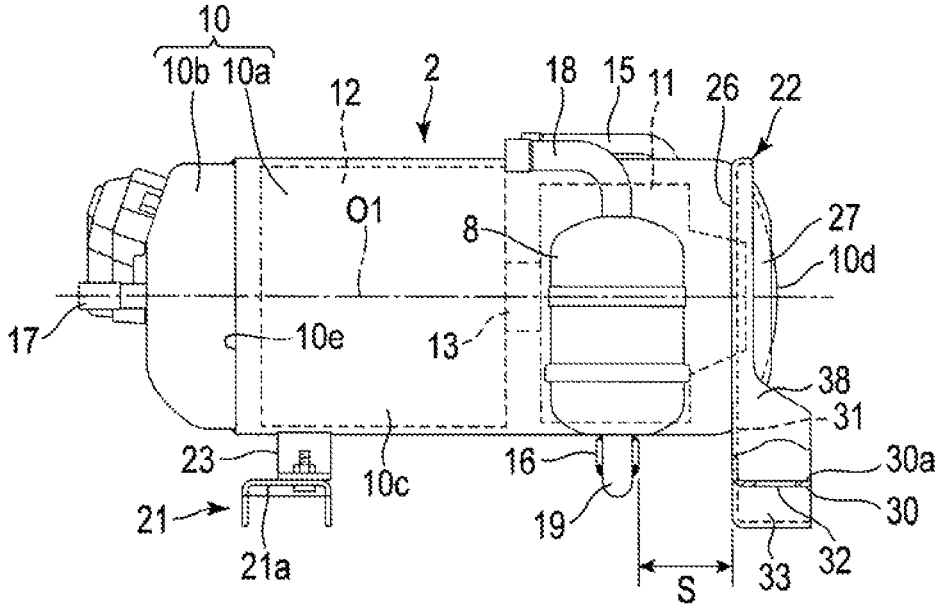
FIG. 3 is a side view of the horizontal compressor according to the first embodiment.

As illustrated in FIGS. 2 and 3, the compression mechanism unit 11 is housed in the container body 10*a* so as to be adjacent to the bottom plate portion 10*d* of the container body 10*a*. The compression mechanism unit 11 includes a cylinder chamber that compresses a gas-phase refrigerant sucked from the accumulator 8. The gas-phase refrigerant compressed in the cylinder chamber is discharged into the hermetic container 10.

The electric motor unit 12 is an element that drives the compression mechanism unit 11, and the electric motor unit 12 is connected to the compression mechanism unit 11 via a rotary shaft 13. The electric motor unit 12 is housed in the container body 10*a* at a position near the lid member 10*b* relative to the compression mechanism unit 11. Therefore, the compression mechanism unit 11 and the electric motor unit 12 are aligned in an axial direction of the hermetic container 10.

Figure 4:
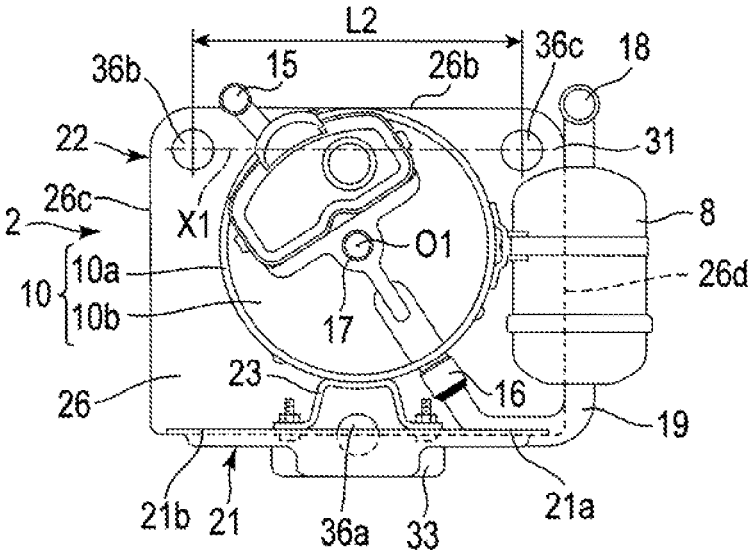
FIG. 4 is a front view of the horizontal compressor according to the first embodiment.

As illustrated in FIGS. 2 to 4, a discharge pipe 15 and a joint port 16 are mounted on the outer peripheral wall 10*c* of the container body 10*a*. The discharge pipe 15 opens inside the container body 10*a* at a position corresponding to the compression mechanism unit 11 and is connected to the first port 3*a* of the four-way valve 3.

The joint port 16 is an element configured to guide a gas-phase refrigerant from the accumulator 8 to the cylinder chamber of the compression mechanism unit 11, and the joint port 16 protrudes from an outer peripheral surface of the container body 10*a* at a position corresponding to the compression mechanism unit 11. As illustrated in FIG. 4, while the hermetic container 10 is in a horizontal attitude, the joint port 16 protrudes downward from the outer peripheral wall 10*c* of the container body 10*a*.

Furthermore, in the hermetic container 10 according to the present embodiment, a lubricant pipe 17 is mounted to the center of the lid member 10*b*. The lubricant pipe 17 is an element that is used to seal lubricant inside the hermetic container 10, and the lubricant pipe 17 is located, for example, on a center line O1 of the hermetic container 10 in a coaxial manner.

As illustrated in FIGS. 2 and 3, the accumulator 8 is attached to the hermetic container 10 so as to be located beside the compression mechanism unit 11. In the present embodiment, the accumulator 8 is supported on the outer peripheral wall 10*c* of the container body 10*a* in an attitude orthogonal to the center line O1 of the hermetic container 10.

A suction pipe 18 that constitutes part of the circulation circuit 7 is connected to one end of the accumulator 8. The suction pipe 18 is connected to the fourth port 3*d* of the four-way valve 3. Furthermore, a refrigerant return pipe 19 that constitutes part of the circulation circuit 7 is connected to the other end of the accumulator 8. The refrigerant return pipe 19 extends between the other end of the accumulator 8 and the joint port 16 of the hermetic container 10 and has a downstream end in a refrigerant flow direction that is fixed to an opening end of the joint port 16 by means such as brazing.

As illustrated in FIGS. 2 to 4, the horizontal compressor 2 includes a first leg 21 and a second leg 22 that support the hermetic container 10 in a horizontal attitude on the installation surface G for the air conditioner 1.

The first leg 21 is an integrally formed member obtained by subjecting a metal sheet material, such as cold-rolled sheet steel or hot-rolled sheet steel, to sheet metal pressing, and the first leg 21 has an elongated shape. The first leg 21 is fixed to a holder 23 secured to the outer peripheral wall 10*c* of the container body 10*a*, by means such as screwing. According to this embodiment, the first leg 21 extends in a direction orthogonal to the center line O1 of the hermetic container 10, near the opening end 10*e* of the container body 10*a* corresponding to the electric motor unit 12.

Therefore, the first leg 21 has a first end portion 21*a* and a second end portion 21*b* that are separated in a radial direction of the hermetic container 10. The first end portion 21*a* and the second end portion 21*b* have a flat shape facing the installation surface G, and mounting holes 24 are defined in the first end portion 21*a* and the second end portion 21*b*.

The second leg 22 is an integrally formed member obtained by subjecting a metal sheet material, such as cold-rolled sheet steel or hot-rolled sheet steel, to sheet metal pressing, and the second leg 22 is located at an end of the hermetic container 10 corresponding to the compression mechanism unit 11.

More specifically, as illustrated in FIGS. 2 to 5, the second leg 22 includes a plate-shaped base portion 26 that expands radially from the hermetic container 10. A recessed portion 27 is formed in the center of the base portion 26. The recessed portion 27 is an element with which the bottom plate portion 10*d* of the container body 10*a* is fitted, and the recessed portion 27 has a shape that conforms to the bottom plate portion 10*d* of spherical shape. A circular opening portion 28 that is a cutout is defined in a terminal end of the recessed portion 27 so as to avoid the top of the bottom plate portion 10*d*.

The base portion 26 is fixed to the bottom plate portion 10*d* of the container body 10*a* by means such as welding. By the fixing, the base portion 26 is held in an attitude orthogonal to the center line O1 of the hermetic container 10, and the outer periphery of the base portion 26 expands around the hermetic container 10.

According to the present embodiment, the outer periphery of the base portion 26 is defined by a first to fourth outer peripheral edges 26*a*, 26*b*, 26*c*, and 26*d*. The first outer peripheral edge 26*a* extends radially from the hermetic container 10 at a position adjacent to the joint port 16. The second outer peripheral edge 26*b* is located on the opposite side from the first outer peripheral edge 26*a* across the hermetic container 10, and extends radially from the hermetic container 10, parallel to the first outer peripheral edge 26*a*. The third outer peripheral edge 26*c* linearly connects one end of the first outer peripheral edge 26*a* and one end of the second outer peripheral edge 26*b*. The fourth outer peripheral edge 26*d* linearly connects the other end of the first outer peripheral edge 26*a* and the other end of the second outer peripheral edge 26*b*.

Figure 5:
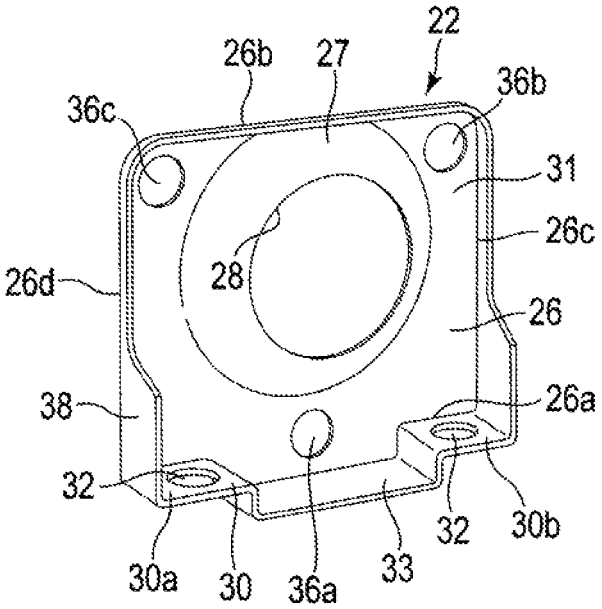
FIG. 5 is a perspective view of a second leg used in the first embodiment.

As best illustrated in FIGS. 3 and 5, the base portion 26 of the second leg 22 includes a first support portion 30 and a second support portion 31. The first support portion 30 is a plate-shaped element that faces the installation surface G on the same side as the joint port 16 when supporting the hermetic container 10 in a horizontal attitude, and the first support portion 30 is formed by bending an outer periphery corresponding to the first outer peripheral edge 26*a* of the base portion 26 at a right angle in a direction away from the first leg 21.

In other words, the first support portion 30 extends in a direction orthogonal to the center line O1 of the hermetic container 10 so as to be parallel to the first leg 21 and extends from the first outer peripheral edge 26*a* of the base portion 26 in a direction away from the joint port 16. Therefore, as illustrated in FIG. 3, an end of the first support portion 30 is located on the opposite side from the joint port 16, and a sufficient space S is ensured between the first support portion 30 and the joint port 16.

Furthermore, the first support portion 30 has a first end portion 30*a* and a second end portion 30*b* that are separated in a radial direction of the hermetic container 10. The first end portion 30*a* and the second end portion 30*b* are formed into a flat shape and located on the same plane as the first end portion 21*a* and the second end portion 21*b* of the first leg 21. A mounting hole 32 is defined in each of the first end portion 30*a* and the second end portion 30*b*.

According to the present embodiment, the first support portion 30 has a bent portion 33 that is located between the first end portion 30*a* and the second end portion 30*b*. The bent portion 33 is an element configured to reinforce the first support portion 30, and the bent portion 33 has a shape that is integrally bent in a direction away from the hermetic container 10.

The second support portion 31 is an element that is used in the process of manufacturing the horizontal compressor 2, for example, to support the hermetic container 10 in a standing attitude on a transport pallet 35 placed on a factory floor F, and in the present embodiment, the outer periphery of the base portion 26 also serves as the second support portion 31. Therefore, the first support portion 30 and the second support portion 31 have an integrated structure in which the first support portion 30 and the second support portion 31 are maintained in an orthogonal positional relationship.

First to third fitting holes 36*a*, 36*b*, and 36*c* are defined in the second support portion 31. The first to third fitting holes 36*a*, 36*b*, and 36*c* are elements into which three support pins 37 protruding upward from the transport pallet 35 are removably fitted to support the hermetic container 10 in a standing attitude. Fitting the tips of the support pins 37 into the first to third fitting holes 36*a*, 36*b*, and 36*c* fixedly determines the position of the hermetic container 10 with respect to the transport pallet 35.

According to the present embodiment, as illustrated in FIG. 4, while the hermetic container 10 is in a horizontal attitude, the first fitting hole 36*a* is located immediately below the center line O1 of the hermetic container 10. Likewise, the second fitting hole 36*b* and the third fitting hole 36*c* are separately arranged on both sides of the hermetic container 10 in the upper portion of the second support portion 31.

In other words, the second fitting hole 36*b* and the third fitting hole 36*c* are provided at positions not immediately above the center line O1 of the hermetic container 10 while the hermetic container 10 is in a horizontal attitude. When the center of the second fitting hole 36*b* and the center of the third fitting hole 36*c* are joined by a straight line X1, the straight line X1 extends laterally so as to be parallel to the installation surface G.

As illustrated in FIGS. 2 and 4, when a pitch between the mounting holes 24 of the first leg 21 is L1, and a pitch between the second fitting hole 36*b* and the third fitting hole 36*c* is L2, L1 and L2 satisfy a relationship L1>L2. Furthermore, when a pitch between the mounting holes 32 defined in the first support portion 30 of the second leg 22 is L3, L1 and L3 satisfy a relationship L1=L3.

A reinforcing rib 38 is formed integrally with the second to fourth outer peripheral edges 26*b*, 26*c*, and 26*d* of the base portion 26. The reinforcing rib 38 is formed by bending the second to fourth outer peripheral edges 26*b*, 26*c*, and 26*d* of the base portion 26 backward at a right angle in a direction away from the first leg 21. The reinforcing rib 38 is continuous with the first end portion 30*a* and second end portion 30*b* of the first support portion 30, and the bending has a bending height increasing toward the first end portion 30*a* and the second end portion 30*b*. Therefore, the reinforcing rib 38 extends between the first support portion 30 and the second support portion 31.

Figure 6:
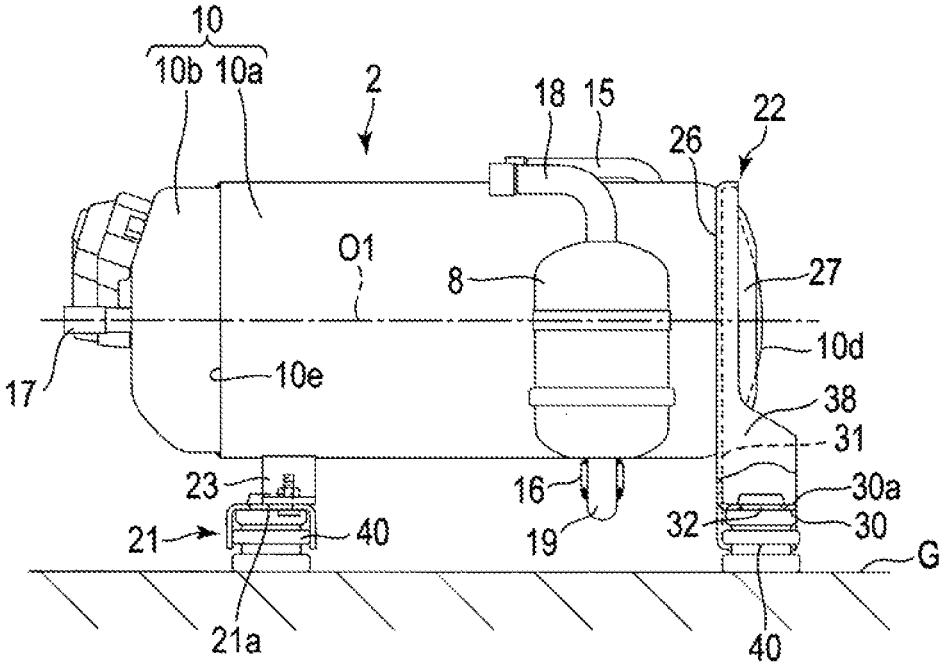
FIG. 6 is a side view illustrating a state in which the horizontal compressor is installed in a horizontal attitude on a horizontal installation surface in the first embodiment.
Figure 7:
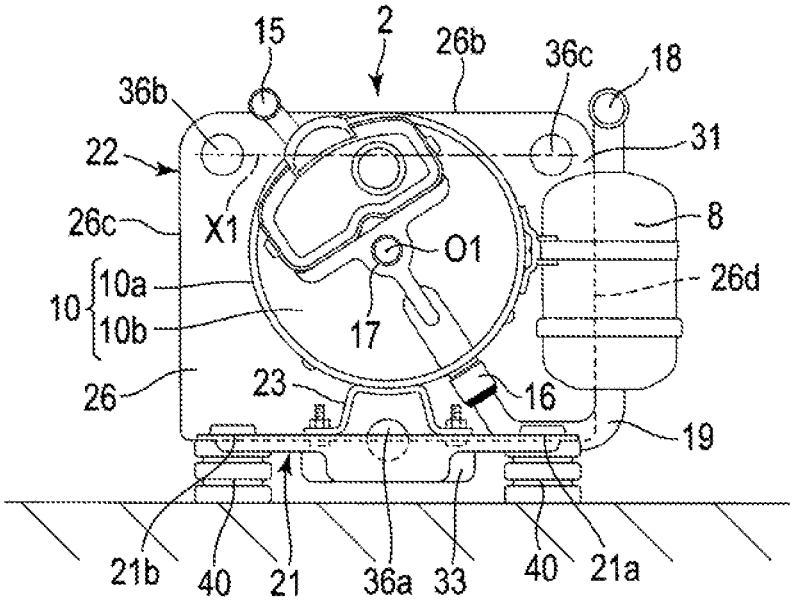
FIG. 7 is a front view illustrating a state in which the horizontal compressor is installed in a horizontal attitude on a horizontal installation surface in the first embodiment.

FIGS. 6 and 7 illustrate a state in which the horizontal compressor 2 is installed in a horizontal attitude on the installation surface G. In this case, the first leg 21 of the hermetic container 10 and the first support portion 30 of the second leg 22 are each placed on the installation surface G via a pair of vibration dampers 40. Each of the vibration damper 40 is formed of, for example, a cylindrical rubber material. The vibration dampers 40 are interposed, in a compressed state, between the first leg 21 and the installation surface G and between the first support portion 30 of the second leg 22 and the installation surface G. Upper ends of the respective vibration dampers 40 are fitted into the mounting holes 24 and 32.

On the other hand, in the final stage of assembling the horizontal compressor 2, injection of lubricant from the lubricant pipe 17 into the hermetic container 10 and start-up check are performed. From the viewpoint of manufacturability and quality assurance of the horizontal compressor 2, it is preferable to perform injection of lubricant and start-up check on the hermetic container 10 in a vertical standing attitude.

In the present embodiment, the base portion 26 of the second leg 22 also functions as the second support portion 31, and the first to third fitting holes 36*a*, 36*b*, and 36*c* are defined in the second support portion 31. Therefore, in order to stand the hermetic container 10, the tips of the support pins 37 protruding upward from the transport pallet 35 positioned horizontally are fitted into the first to third fitting holes 36*a*, 36*b*, and 36*c*.

Figure 8:
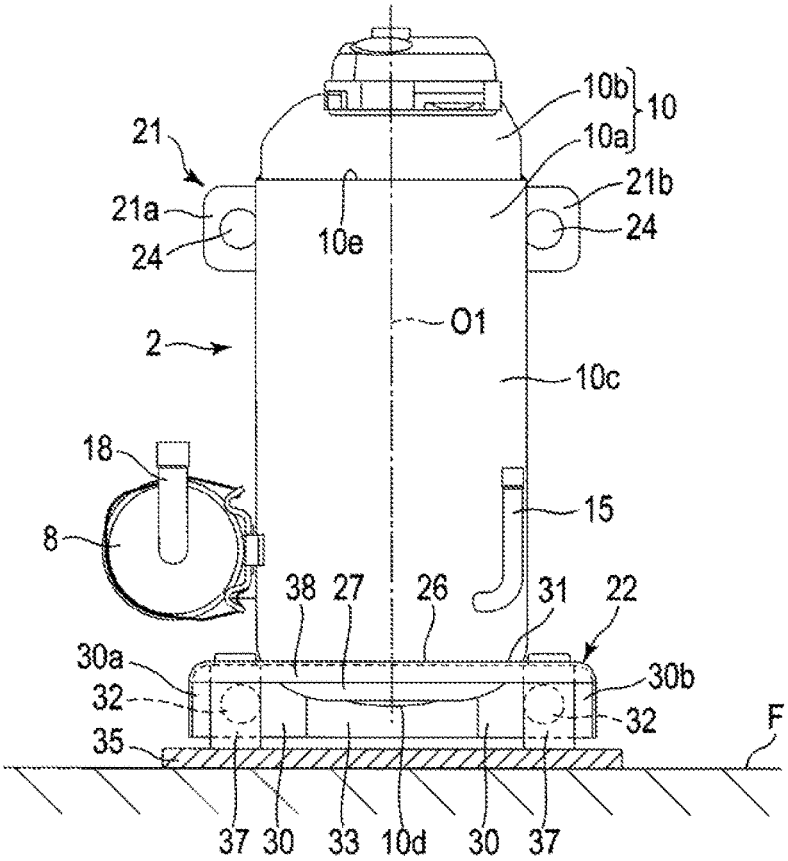
FIG. 8 is a side view illustrating a state in which the horizontal compressor is installed in a vertical standing attitude on a transport pallet in the first embodiment.
Figure 9:
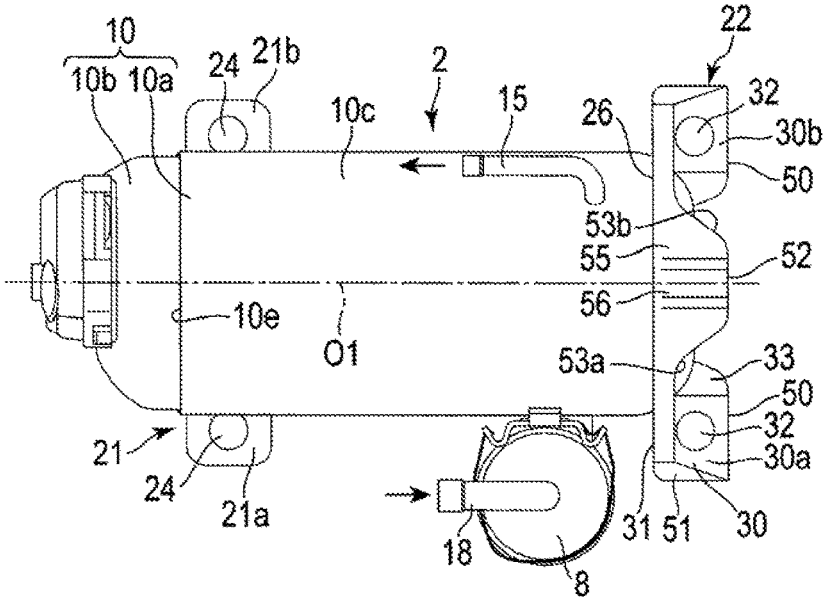
FIG. 9 is a plan view of a horizontal compressor according to a second embodiment.
Figure 10:
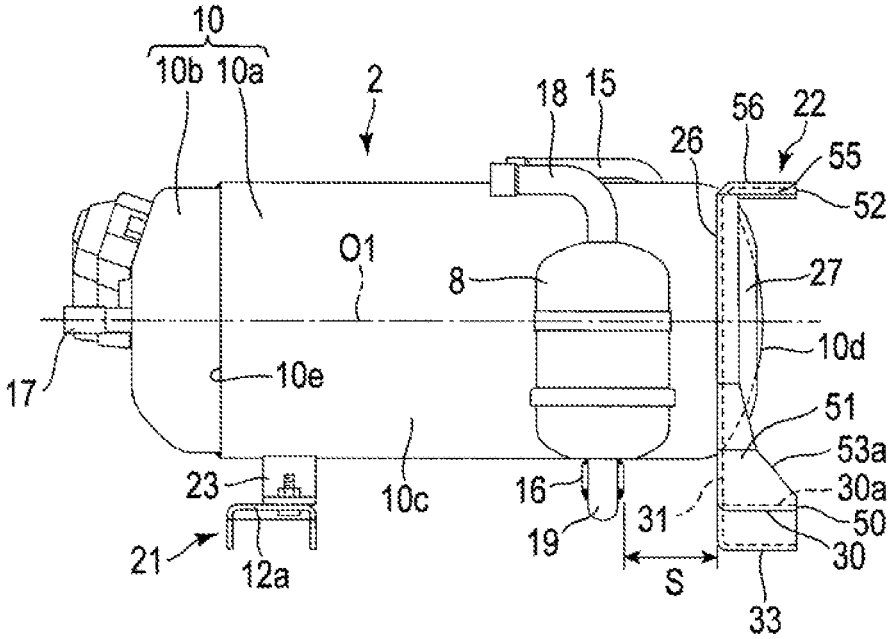
FIG. 10 is a side view of the horizontal compressor according to the second embodiment.
Figure 11:
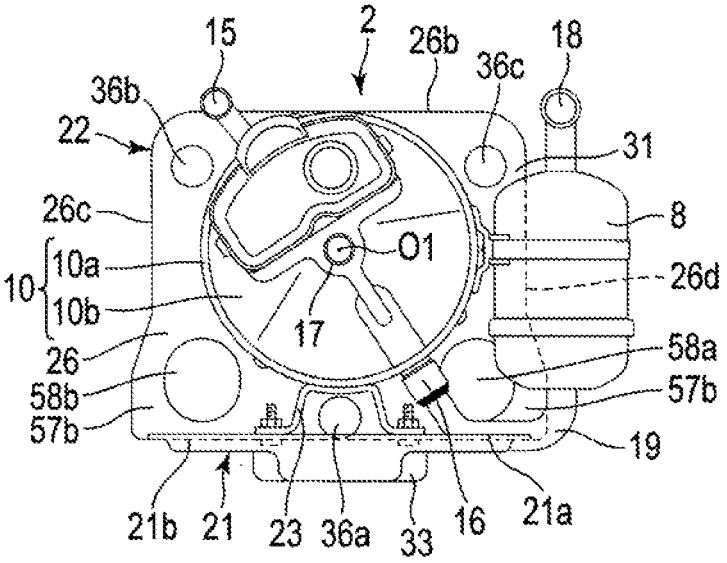
FIG. 11 is a front view of the horizontal compressor according to the second embodiment.

Thus, as illustrated in FIG. 8, the hermetic container 10 is held in a standing attitude on the transport pallet 35, at the three positions of the second support portion 31. At this time, the first support portion 30 of the second leg 22 is separated from an upper surface of the transport pallet 35, maintaining the stability in standing the hermetic container 10.

According to the first embodiment, the second leg 22 fixed to the bottom plate portion 10*d* of the hermetic container 10 integrally includes the first support portion 30 that is used to install the hermetic container 10 in a horizontal attitude on the installation surface G, and the second support portion 31 that is used to stand the hermetic container 10 on the transport pallet 35.

Accordingly, the second leg 22 has an integrated structure with both of the function of supporting the hermetic container 10 in a horizontal attitude and the function of standing the hermetic container 10. Therefore, the horizontal compressor 2 can be provided that is reduced in the number of components and labor-hours for assembling and thereby cost-effective, in comparison with a horizontal compressor that includes separate elements to perform the two functions.

Moreover, according to the present embodiment, the first support portion 30 of the second leg 22 extends in a direction away from the joint port 16 of the hermetic container 10, ensuring the sufficient space S between the joint port 16 and the first support portion 30. Therefore, in brazing the refrigerant return pipe 19 to the joint port 16, even if the second leg 22 is already welded to the hermetic container 10, the first support portion 30 of the second leg 22 does not hinder the brazing, improving workability in assembling the horizontal compressor 2.

In addition, the first support portion 30 does not hinder covering the refrigerant return pipe 19 or joint port 16 with a heat insulating material, facilitating attaching the heat insulating material to the refrigerant return pipe 19 or the joint port 16.

Furthermore, the second leg 22 includes the reinforcing rib 38 extending between the first support portion 30 and the second support portion 31, and the reinforcing rib 38 is continuous with the second outer peripheral edge 26*b*, third outer peripheral edge 26*c*, and fourth outer peripheral edge 26*d* of the base portion 26. Therefore, the strength and rigidity of the first support portion 30 that is bent at a right angle from the base portion 26 are improved, supporting the horizontal compressor 2 in a stable attitude on the installation surface G.

Furthermore, the reinforcing rib 38 surrounds the base portion 26 that also functions as the second support portion 31 in cooperation with the first support portion 30, improving the strength and rigidity of the base portion 26. Therefore, when the horizontal compressor 2 is stood on the transport pallet 35, the support pins 37 of the transport pallet 35 can be firmly received by the base portion 26. Thus, the horizontal compressor 2 can be stood in a stable attitude on the transport pallet 35.

According to the present embodiment, as illustrated in FIG. 7, while the horizontal compressor 2 is installed in a horizontal attitude on the installation surface G, the base portion 26 of the second leg 22 stands on the installation surface G, and the second fitting hole 36*b* and the third fitting hole 36*c* that are located in the upper portion of the base portion 26 are separately arranged on both sides of the hermetic container 10.

Thus, the second fitting hole 36*b* or third fitting hole 36*c* is located at a position not immediately above the center line O1 of the hermetic container 10, preventing the second fitting hole 36*b* or the third fitting hole 36*c* from greatly expanding above the hermetic container 10 in a horizontal attitude.

In addition, the straight line X1 joining the center of the second fitting hole 36*b* and the center of the third fitting hole 36*c* extends laterally so as to be parallel to the installation surface G, thus, reducing, as much as possible, a height dimension from the second outer peripheral edge 26*b* located at the upper edge of the base portion 26 to the installation surface G while the hermetic container 10 is in a horizontal attitude.

In other words, when the horizontal compressor 2 is installed in a horizontal attitude on the installation surface G, an expansion height of the second leg 22 with respect to the installation surface G can be minimized. Therefore, although the second leg 22 has both of the function of supporting the hermetic container 10 in a horizontal attitude and the function of standing the hermetic container 10, the second leg 22 can be made compact.

According to the present embodiment, the pitch L1 between the mounting holes 24 of the first leg 21 and the pitch L3 between the mounting holes 32 of the first support portion 30 of the second leg 22 are larger than the pitch L2 between the second fitting hole 36*b* and the third fitting hole 36*c*. Therefore, it is possible to sufficiently secure an arrangement interval of the vibration dampers 40 fitted into the mounting holes 24 and 32, supporting the horizontal compressor 2 in a stable attitude on the installation surface G.

Furthermore, the second fitting hole 36*b* and the third fitting hole 36*c* are elements that are used to temporarily stand the hermetic container 10 in the manufacturing process of the horizontal compressor 2, and the pitch L2 between the second fitting hole 36*b* and the third fitting hole 36*c* may be smaller than the pitch L3 between the mounting holes 32 without any particular problem.

At the same time, by making the pitch L2 between the second fitting hole 36*b* and the third fitting hole 36*c* smaller than the pitch L3 between the mounting holes 32, the whole length of the second outer peripheral edge 26*b* of the base portion 26 can be reduced, and this advantageously contributes to compactification of the second leg 22.

Second Embodiment

FIGS. 9 to 14 disclose a second embodiment. The second embodiment is different from the first embodiment in a structure of a second leg 22. The other configurations of a horizontal compressor 2 are the same as those in the first embodiment. Therefore, in the second embodiment, the same components as those in the first embodiment are denoted by the same reference numerals, and the description thereof will be omitted.

Figure 12:
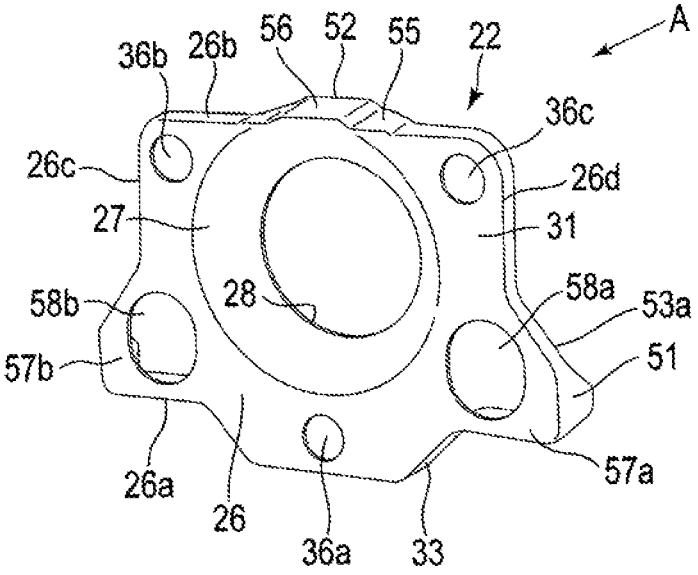
FIG. 12 is a perspective view of a second leg used in the second embodiment.
Figure 13:
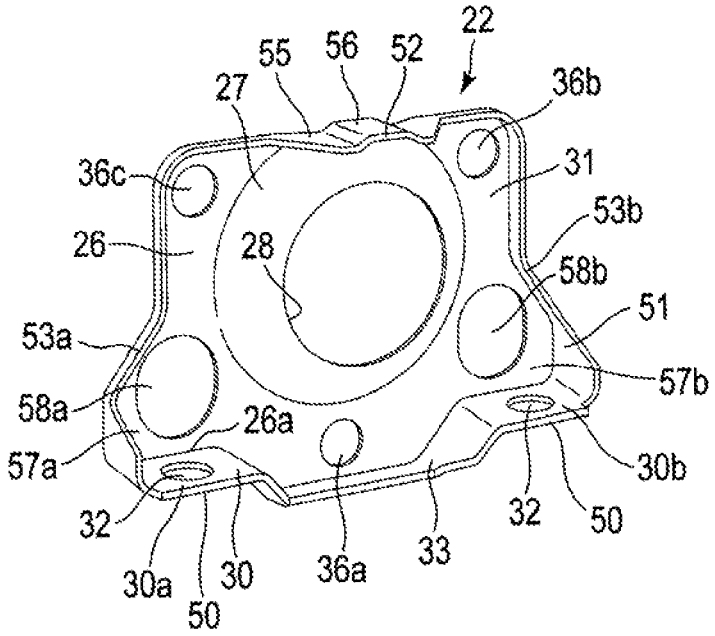
FIG. 13 is a perspective view of the second leg as viewed in a direction indicated by an arrow A in FIG. 12.

As best illustrated in FIGS. 12 and 13, a first end portion 30*a* and a second end portion 30*b* of a first support portion 30 each have a straight front end edge 50 that is parallel with a second support portion 31 while a hermetic container 10 is stood in a vertical attitude.

Furthermore, a base portion 26 forming the second support portion 31 includes a peripheral wall 51 bent backward at a right angle from second to fourth outer peripheral edges 26*b*, 26*c*, and 26*d*. The peripheral wall 51 protrudes in a direction away from the hermetic container 10 while the hermetic container 10 is stood. The peripheral wall 51 includes an end edge 52 that is located on the same plane as the front end edges 50 of the first support portion 30.

The peripheral wall 51 has a pair of clearance portions 53*a* and 53*b* that are cutouts opening in the end edge 52. Due to the presence of the clearance portions 53*a* and 53*b*, the end edge 52 is spatially divided into portions separated from each other in the circumferential direction of the hermetic container 10. In the peripheral wall 51, an intermediate portion 55 located between the clearance portions 53*a* and 53*b* is located on the opposite side from the first support portion 30 across the hermetic container 10.

Furthermore, a reinforcing rib 56 is formed in the intermediate portion 55 of the peripheral wall 51. The reinforcing rib 56 is configured by, for example, partially bending the intermediate portion 55 of the peripheral wall 51 in a direction away from the first support portion 30.

In addition, in the present embodiment, the third outer peripheral edge 26*c* and the fourth outer peripheral edge 26*d* of the base portion 26 each have a portion that is continuous with the first support portion 30, and the portions incline in directions away from each other. Therefore, the base portion 26 includes a pair of expanded portions 57*a* and 57*b* that are expanded radially from the hermetic container 10 at positions near the first support portion 30, and a pitch L1 between mounting holes 32 of the first support portion 30 is extended by the lengths of the expanded portions 57*a* and 57*b*, as compared with that in the first embodiment.

Furthermore, a pair of through-holes 58*a* and 58*b* are defined in the expanded portions 57*a* and 57*b* of the base portion 26 for weight reduction. The through-holes 58*a* and 58*b* are separately arranged on both sides of the hermetic container 10.

Figure 14:
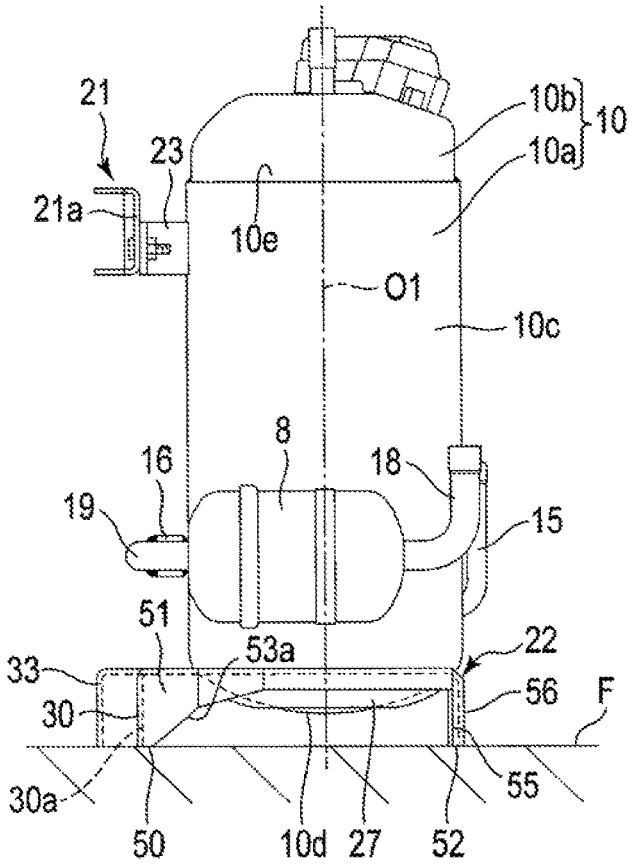
FIG. 14 is a side view illustrating a state in which the horizontal compressor is temporarily placed in a vertical standing attitude on a factory floor, in the second embodiment.

According to the second embodiment, the front end edges 50 of the first support portion 30 and the end edge 52 of the peripheral wall 51 of the base portion 26 are located on the same plane. Therefore, as illustrated in FIG. 14, for example, when the hermetic container 10 is stood on a factory floor F, a front end edge 50 of the first support portion 30 and the end edge 52 of the peripheral wall 51 of the base portion 26 abut on the floor F.

This makes it possible to temporarily place the hermetic container 10 in a standing attitude on the factory floor F by using the front end edges 50 of the first support portion 30 and the end edge 52 of the peripheral wall 51. Thus, an extremely advantageous structure is provided, for example, to temporarily stand the hermetic container 10 before placing on the transport pallet 35, in the final stage of assembling the horizontal compressor 2.

Moreover, the end edge 52 of the peripheral wall 51 is spatially divided from the front end edges 50 by the clearance portions 53*a* and 53*b* in the circumferential direction of the hermetic container 10. Therefore, the end edge 52 will abut on the floor F at three positions along the circumferential direction of the hermetic container 10, suppressing rattling or wobbling of the hermetic container 10 stood on the floor F.

Furthermore, the intermediate portion 55 of the peripheral wall 51 is reinforced by the reinforcing ribs 56, and thus, the strength and rigidity of the intermediate portion 55 can be sufficiently ensured, and the hermetic container 10 can be firmly supported by the intermediate portion 55 of the peripheral wall 51.

At the same time, the presence of the reinforcing ribs 56 makes it possible to reduce the thickness of the peripheral wall 51 and further the base portion 26, thereby reducing the weight of the second leg 22.

Third Embodiment

Figure 15:
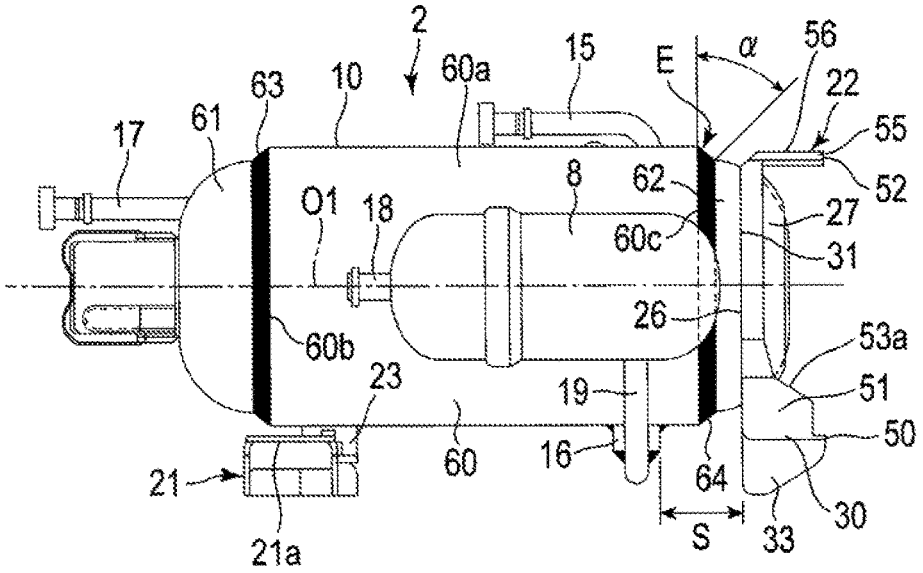
FIG. 15 is a side view of a horizontal compressor according to a third embodiment.
Figure 16:
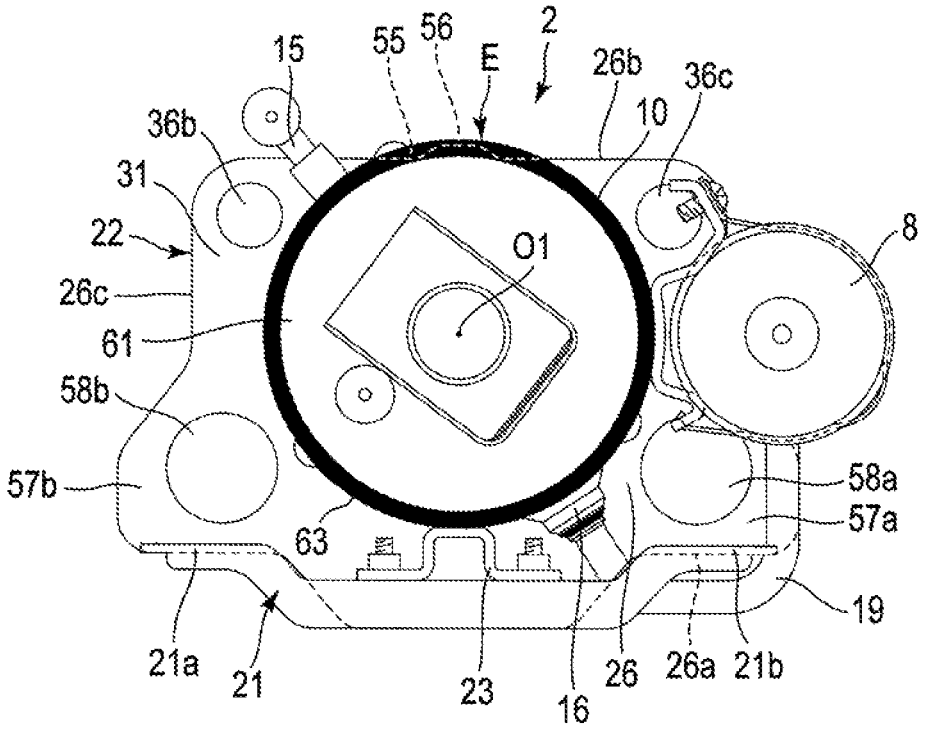
FIG. 16 is a front view of the horizontal compressor according to the third embodiment.

FIGS. 15 and 16 disclose a third embodiment. The third embodiment is different from the first embodiment in a configuration of a hermetic container 10 of a horizontal compressor 2. The other configurations of a horizontal compressor 2 are the same as those in the first embodiment. Therefore, in the third embodiment, components having the same configurations as those in the first embodiment are denoted by the same reference numerals, and the description thereof will be omitted.

As illustrated in FIG. 15, the hermetic container 10 is divided into three elements of a container body 60, a first lid 61, and a second lid 62. The container body 60 includes a cylindrical outer peripheral wall 60*a*, and further includes circular opening ends 60*b* and 60*c* at one and the other axial ends of an outer peripheral wall 60*a*, respectively.

The first lid 61 that has a substantially hemispherical shape is fitted to one opening end 60*b* of the container body 60, shield-welding is carried out on the entire circumference of the opening end 60*b*, and the first lid 61 is fixed to the container body 60. Therefore, the one opening end 60*b* of the container body 60 is airtightly closed by the first lid 61. The first lid 61 protrudes from the one opening end 60*b* of the container body 60 to the outside of the container body 60, and a circumferentially continuous weld bead 63 is formed at a boundary between the first lid 61 and the container body 60.

The second lid 62 that has a substantially hemispherical shape is fitted to the other opening end 60*c* of the container body 60, shield-welding is carried out on the entire circumference of the opening end 60*c*, and the second lid 62 is fixed to the container body 60. Therefore, the other opening end 60*c* of the container body 60 is airtightly closed by the second lid 62. The second lid 62 protrudes from the other opening end 60*c* of the container body 60 to the outside of the container body 60, and a circumferentially continuous weld bead 64 is formed at a boundary between the second lid 62 and the container body 60. The weld beads 63 and 64 can be also referred to as welded portions.

According to the present embodiment, a second leg 22 that has both of a function of supporting the hermetic container 10 in a horizontal attitude and a function of standing the hermetic container 10 is fixed to an outer peripheral surface of the second lid 62 by means such as welding.

As illustrated in FIG. 16, the second leg 22 includes a base portion 26 in which a first outer peripheral edge 26*a*, a third outer peripheral edge 26*c*, and a fourth outer peripheral edge 26*d* greatly expand in a direction orthogonal to a center line O1 of the hermetic container 10. On the other hand, in the base portion 26, a second outer peripheral edge 26*b*, including an intermediate portion 55 of a peripheral wall 51 in which a reinforcing rib 56 is formed, is slightly retracted from the outer peripheral wall 60*a* of the container body 60. In other words, the second outer peripheral edge 26*b* of the base portion 26 located in the vicinity of the weld bead 64 does not expand radially outward from the hermetic container 10 relative to the weld bead 64, and in the vicinity of the second outer peripheral edge 26*b* of the base portion 26, wide open space is maintained around the weld bead 64.

On the other hand, a first leg 21 is located in the vicinity of the weld bead 63 on the side of the first lid 61, but the first leg 21 only extends radially from the hermetic container 10. Therefore, as illustrated in FIG. 16, in the vicinity of the first leg 21, wide open space is maintained around the weld bead 63 in the circumferential direction of the hermetic container 10.

Incidentally, the work of welding the container body 60, the first lid 61, and the second lid 62 is manually carried out by an operator. In this case, for example, a fitting error that occurs at a fitting portion between the opening end 60*b* of the container body 60 and the first lid 61, a fitting error that occurs at a fitting portion between the opening end 60*c* of the container body 60 and the second lid 62, a work mistake during welding work, or the like may cause a welding defect, such as a blowhole or a pit, at welded portions of the container body 60, the first lid 61, and the second lid 62.

When a welding defect occurs, repair work using a welding electrode is required after completion of all welding steps for the hermetic container 10. The repair work is performed manually by the operator with the hermetic container 10 standing.

Welding defects are highly likely to occur at a welding start point of shield-welding or at a welding end point overlapping the welding start point. In particular, if a welding defect is found in the hermetic container 10 after welding the second leg 22 to the hermetic container 10, the second leg 22 may hinder, making it difficult or impossible to apply the welding electrode to a position where the welding defect occurs, depending on the shape or size of the second leg 22.

According to the present embodiment, wide open space is provided around the weld bead 63, at a welded position between the container body 60 and the first lid 61. Therefore, no matter where the welding start point and the welding end point of the shield-welding are located in the circumferential direction of the hermetic container 10, it is possible to apply the welding electrode to the welding start point or the welding end point of the shield-welding where a welding defect occurs, for repair work.

On the other hand, when the hermetic container 10 is viewed in an axial direction, the first outer peripheral edge 26*a*, the third outer peripheral edge 26*c*, and the fourth outer peripheral edge 26*d* of the base portion 26 greatly expand relative to the second lid 62 in a direction orthogonal to the center line O1 of the hermetic container 10, in the vicinity of a welded portion between the container body 60 and the second lid 62.

Therefore, when the welding electrode is applied to a position where a welding defect occurs, from a side of the second lid 62, the base portion 26 hinders, making it difficult or impossible to apply the welding electrode to the weld bead 64, at positions corresponding to the first outer peripheral edge 26*a*, the third outer peripheral edge 26*c*, and the fourth outer peripheral edge 26*d* of the base portion 26.

In the present embodiment, when the hermetic container 10 is viewed in the axial direction, the second outer peripheral edge 26*b* of the base portion 26 does not expand radially outward from the hermetic container 10 relative to the weld bead 64, and in the vicinity of the second outer peripheral edge 26*b* of the base portion 26, wide open space is maintained around the weld bead 64. Therefore, in the present embodiment, as illustrated in FIG. 16, a welding start point E of shield-welding where a welding defect is likely to occur is set near the second outer peripheral edge 26*b* of the base portion 26.

This configuration enables application of the welding electrode within a range of a predetermined angle α with respect to the weld bead 64, even when a welding defect at the welding start point E of the shield-welding is found after welding the second leg 22 to the hermetic container 10. The predetermined angle α is preferably 30° to 60°, and it is particularly preferable to apply the welding electrode to the weld bead 64 at an angle of 45°.

Therefore, it is possible to readily perform repair work for the welding defect without hindrance by the base portion 26.

In the third embodiment, the welding start point E is located in the vicinity of the second outer peripheral edge 26*b* of the base portion 26 that does not expand radially outward from the hermetic container 10, but the welding start point E of the shield-welding may be located in the vicinity of a portion of the base portion 26 that has a minimum amount of radially outward expansion from the hermetic container 10.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A horizontal compressor comprising:

a cylindrical hermetic container;

a compression mechanism unit that is housed in the hermetic container to compress a refrigerant;

an electric motor unit that is housed in the hermetic container so as to be aligned with the compression mechanism unit in an axial direction of the hermetic container, and drives the compression mechanism unit;

a first leg that is fixed to the hermetic container at a position near the electric motor unit to support the hermetic container in a horizontal attitude on an installation surface;

a second leg that is fixed to an end of the hermetic container located on the side of the compression mechanism unit to support the hermetic container in the horizontal attitude on the installation surface;

an accumulator that is attached to the hermetic container, between the first leg and the second leg; and a joint port that is provided in the hermetic container to join a refrigerant return pipe, the refrigerant return pipe guiding a refrigerant in the accumulator to the compression mechanism unit, wherein the second leg includes:

a first support portion of plate shape that faces the installation surface to support the hermetic container in the horizontal attitude;

a second support portion of plate shape that supports the hermetic container standing in a vertical attitude in which the second leg is located below the first leg; and at least one positioning fitting hole that is provided in the second support portion to position the hermetic container in the vertical attitude, and wherein the first support portion extends in a direction away from the joint port relative to the second support portion.

2. The horizontal compressor according to claim 1, wherein the second leg includes:

a reinforcing rib that extends between the first support portion and the second support portion; and at least one mounting hole that is provided in the first support portion to receive a vibration damper, the vibration damper making contact with the installation surface.

3. The horizontal compressor according to claim 1, wherein the first support portion and the second support portion of the second leg are integrally formed of a metal plate material, and the fitting hole is provided at a position not immediately above a center line extending in an axis direction of the hermetic container while the hermetic container is in the horizontal attitude.

4. The horizontal compressor according to claim 1, wherein the second support portion of the second leg is stood so as to intersect with a center line of the hermetic container while the hermetic container is in the horizontal attitude, the second support portion has two upper portions in which respective fitting holes are provided, the fitting holes are separately arranged on both sides of the hermetic container, and a straight line linking centers of the fitting holes extends laterally.

5. The horizontal compressor according to claim 4, wherein the first leg has a first end portion and a second end portion that are separated in a direction intersecting the center line of the hermetic container, each of the first end portion and the second end portion being provided with a mounting hole that receives a vibration damper, and when a pitch between the mounting holes of the first leg is L1 and a pitch between a pair of the fitting holes is L2, a relationship L1>L2 is satisfied.

6. The horizontal compressor according to claim 1, wherein the first support portion has a front end edge that is parallel to the second support portion while the hermetic container is in the vertical attitude, and the second support portion has a peripheral wall that protrudes in a direction away from the hermetic container while the hermetic container is in the vertical attitude, and the peripheral wall has an end edge that is located on an identical plane to the front end edge of the first support portion.

7. The horizontal compressor according to claim 6, wherein the peripheral wall has a plurality of clearance portions that are cutouts opening in the end edge, the end edge is spatially divided into portions separated from each other in a circumferential direction of the hermetic container due to the presence of the clearance portions, and a reinforcing rib is provided in an intermediate portion of the peripheral wall between the clearance portions.

8. A refrigeration cycle system comprising:

a circulation circuit in which a refrigerant circulates and to which a radiator, an expansion device, and a heat absorber are connected; and the horizontal compressor according to claim 1, the horizontal compressor being connected to the circulation circuit between the heat absorber and the radiator.

9. The horizontal compressor according to claim 1, wherein the hermetic container includes a cylindrical container body, a first lid joined to one opening end of the container body, and a second lid joined to the other opening end of the container body, the second leg being fixed to the second lid, and a welding start point that joins the container body and the second lid is provided near a position where the second leg is retracted radially inward from the hermetic container relative to an outer peripheral surface of the hermetic container or a position where the second leg has a minimum amount of radially outward expansion from the hermetic container, when the hermetic container is viewed in an axial direction.

10. A horizontal compressor comprising:

a cylindrical hermetic container;

a compression mechanism unit that is housed in the hermetic container to compress a refrigerant;

an electric motor unit that is housed in the hermetic container so as to be aligned with the compression mechanism unit in an axial direction of the hermetic container, and drives the compression mechanism unit;

a first leg that is fixed to the hermetic container at a position near the electric motor unit to support the hermetic container in a horizontal attitude on an installation surface;

a second leg that is fixed to an end of the hermetic container located on the side of the compression mechanism unit to support the hermetic container in the horizontal attitude on the installation surface;

an accumulator that is attached to the hermetic container, between the first leg and the second leg; and a joint port that is provided in the hermetic container to join a refrigerant return pipe, the refrigerant return pipe guiding a refrigerant in the accumulator to the compression mechanism unit, wherein the second leg includes:

a first support portion of plate shape that faces the installation surface to support the hermetic container in the horizontal attitude; and a second support portion of plate shape that supports the hermetic container standing in a vertical attitude, and wherein the first support portion extends in a direction away from the joint port relative to the second support portion, wherein the first support portion has a front end edge that is parallel to the second support portion while the hermetic container is in the vertical attitude, and the second support portion has a peripheral wall that protrudes in a direction away from the hermetic container while the hermetic container is in the vertical attitude, and the peripheral wall has an end edge that is located on an identical plane to the front end edge of the first support portion, and wherein the peripheral wall has a plurality of clearance portions that are cutouts opening in the end edge, the end edge is spatially divided into portions separated from each other in a circumferential direction of the hermetic container due to the presence of the clearance portions, and a reinforcing rib is provided in an intermediate portion of the peripheral wall between the clearance portions.

11. A refrigeration cycle system comprising:

a circulation circuit in which a refrigerant circulates and to which a radiator, an expansion device, and a heat absorber are connected; and the horizontal compressor according to claim 10, the horizontal compressor being connected to the circulation circuit between the heat absorber and the radiator.

12. A horizontal compressor comprising:

a cylindrical hermetic container;

a compression mechanism unit that is housed in the hermetic container to compress a refrigerant;

an electric motor unit that is housed in the hermetic container so as to be aligned with the compression mechanism unit in an axial direction of the hermetic container, and drives the compression mechanism unit;

a first leg that is fixed to the hermetic container at a position near the electric motor unit to support the hermetic container in a horizontal attitude on an installation surface;

a second leg that is fixed to an end of the hermetic container located on the side of the compression mechanism unit to support the hermetic container in the horizontal attitude on the installation surface;

an accumulator that is attached to the hermetic container, between the first leg and the second leg; and a joint port that is provided in the hermetic container to join a refrigerant return pipe, the refrigerant return pipe guiding a refrigerant in the accumulator to the compression mechanism unit, wherein the second leg includes:

a first support portion of plate shape that faces the installation surface to support the hermetic container in the horizontal attitude; and a second support portion of plate shape that supports the hermetic container standing in a vertical attitude, and wherein the first support portion extends in a direction away from the joint port relative to the second support portion, wherein the hermetic container includes a cylindrical container body, a first lid joined to one opening end of the container body, and a second lid joined to the other opening end of the container body, the second leg being fixed to the second lid, and a welding start point that joins the container body and the second lid is provided near a position where the second leg is retracted radially inward from the hermetic container relative to an outer peripheral surface of the hermetic container or a position where the second leg has a minimum amount of radially outward expansion from the hermetic container, when the hermetic container is viewed in an axial direction.

13. A refrigeration cycle system comprising:

a circulation circuit in which a refrigerant circulates and to which a radiator, an expansion device, and a heat absorber are connected; and the horizontal compressor according to claim 12, the horizontal compressor being connected to the circulation circuit between the heat absorber and the radiator.

* * * * *